US006402378B1

(12) United States Patent
Shackleton

(10) Patent No.: US 6,402,378 B1
(45) Date of Patent: Jun. 11, 2002

(54) FLEXIBLE CONTAINER HAVING AN ENLARGED INTERIOR BAFFLE SPACE

(76) Inventor: William Shackleton, 5452 - 53 Avenue S.E., Calgary, Alberta (CA), T2C 4B6

( * ) Notice: Subject to any disclaimer, the term of this patent is extended or adjusted under 35 U.S.C. 154(b) by 0 days.

(21) Appl. No.: 09/250,513

(22) Filed: Feb. 16, 1999

(30) Foreign Application Priority Data

Feb. 2, 1999 (CA) ..... 2260588

(51) Int. Cl.[7] ..... B65D 33/02
(52) U.S. Cl. ..... 383/119; 52/226
(58) Field of Search ..... 383/105, 107, 383/119; 53/226; 493/472, 469

(56) References Cited

U.S. PATENT DOCUMENTS

| | | | | |
|---|---|---|---|---|
| 4,207,937 A | * | 6/1980 | Sandeman et al. | 383/119 X |
| 4,493,109 A | * | 1/1985 | Nattrass | 383/119 X |
| 5,071,025 A | | 12/1991 | Boots | |
| 5,076,710 A | | 12/1991 | Derby | |
| 5,165,802 A | | 11/1992 | Derby | |
| 5,222,812 A | | 6/1993 | Cuddy et al. | |
| 5,289,937 A | | 3/1994 | Boots | |
| 5,316,387 A | | 5/1994 | Polett et al. | |
| 5,328,267 A | | 7/1994 | Cuddy et al. | |
| 5,328,268 A | | 7/1994 | Lafleur | |
| 5,407,090 A | | 4/1995 | Boots | |
| 5,421,804 A | | 6/1995 | Lafleur | |
| 5,468,528 A | | 11/1995 | Shnaars et al. | |
| 5,538,155 A | | 7/1996 | Hoekstra | |
| 5,556,205 A | | 9/1996 | Gallie et al. | |
| 5,562,227 A | | 10/1996 | Takezawa et al. | |
| 5,564,833 A | | 10/1996 | Proffitt | |
| 5,618,255 A | | 4/1997 | Nickell et al. | |
| 5,647,832 A | | 7/1997 | Nickell et al. | |
| 5,649,767 A | | 7/1997 | Nickell et al. | |
| 5,660,478 A | | 8/1997 | Alack et al. | |
| 5,664,887 A | | 9/1997 | Lafleur | |
| 5,685,644 A | | 11/1997 | Taylor | |
| 5,785,175 A | | 7/1998 | Cholsaipant | |
| 5,873,655 A | * | 2/1999 | Echeverria | 383/119 |

FOREIGN PATENT DOCUMENTS

| | | | | |
|---|---|---|---|---|
| CA | 2106550 | | 5/1994 | |
| WO | WO 92/14660 | * | 9/1992 | 383/119 |

* cited by examiner

*Primary Examiner*—Lee Young
*Assistant Examiner*—Robin A. Hylton
(74) *Attorney, Agent, or Firm*—Rodman & Rodman; Terrance N. Kuharchuk

(57) ABSTRACT

A flexible container and a method for constructing the flexible container. The flexible container is comprised of a bottom and a plurality of side walls projecting from the bottom. The side walls and the bottom define a container space and one baffle connection line extends along each of the side walls. A plurality of baffles are contained within the container space, with each baffle being attached to two adjacent side walls of the container along the baffle connection lines for those side walls.

15 Claims, 4 Drawing Sheets

FLEXIBLE CONTAINER HAVING AN ENLARGED INTERIOR BAFFLE SPACE

TECHNICAL FIELD

The present invention relates to a flexible container having a support system comprising internal baffles for assisting in maintaining the shape of the container when it is filled with a material.

BACKGROUND OF THE INVENTION

Flexible containers are commonly used for the handling, storage and transportation of flowable materials. These containers are typically designed to be rectangular in cross-section so that they form "cubes" when filled which can be packed efficiently into storage and transportation facilities such as trucks and warehouses, minimizing the amount of wasted space that may result from other shapes.

Unfortunately, flexible containers have an inherent tendency to bulge when filled so that they do not maintain their intended shape. This bulging typically results in the container having rounded corners and sides which are not straight. This in turn results in the containers being more difficult to handle and store efficiently.

It is well known in the art of flexible containers to employ devices or systems for adding structural support to the container for the purpose of assisting in maintaining the shape of the container.

For example, U.S. Pat. No. 5,076,710 (Derby), U.S. Pat. No. 5,165,802 (Derby), U.S. Pat. No. 5,222,812 (Cuddy et al), U.S. Pat. No. 5,328,267 (Cuddy et al), U.S. Pat. No. 5,468,528 (Shnaars et al), U.S. Pat. No. 5,556,205 (Gallie), U.S. Pat. No. 5,564,833 (Proffitt) and U.S. Pat. No. 5,685,644 (Taylor) all describe the use of "corner baffles" which span adjacent sides of flexible containers in order to add support to the container. These corner baffles include apertures of a variety of shapes such as circles, rectangles, diamonds and triangles for permitting material to pass between sides of the baffles. A variety of different configurations for the baffles is described in these references, but all are attached such that in a rectangular shaped container, there are eight locations of connection between the baffles and the side walls of the container.

U.S. Pat. No. 5,071,025 (Boots), U.S. Pat. No. 5,289,937 (Boots), U.S. Pat. No. 5,407,090 (Boots), U.S. Pat. No. 5,562,227 (Takezawa et al), U.S. Pat. No. 5,618,255 (Nickell et al) and U.S. Pat. No. 5,649,767 (Nickell et al) all describe container systems that consist of outer structures and inner structures which together provide support for the container through the cooperation of the two structures. Once again, a variety of different configurations for the structures is described, but these container systems all tend to be somewhat complicated and thus would be difficult or costly to manufacture.

U.S. Pat. No. 5,316,387 (Polett et al), U.S. Pat. No. 5,328,268 (Lafleur), U.S. Pat. No. 5,421,804 (Lafleur), U.S. Pat. No. 5,538,155 (Hoekstra), U.S. Pat. No. 5,660,478 (Alack et al), and U.S. Pat. No. 5,664,887 (Lafleur) all describe types of support systems for flexible containers, some of which include baffle structures and some of which do not.

U.S. Pat. No. 5,316,387 (Polett et al) describes three different embodiments of a support system. In a first embodiment, a plurality of loops are attached to the inside surfaces of the walls of the container at a plurality of levels. A rope or the like is then passed through each loop at a level and the rope is then joined at its ends. Each loop is separately attached to a wall so that there are four attachment points per level for a four sided container. In a second embodiment, a plurality of panels are provided, each of which have one edge affixed to the inside surface of one wall of the container and extend toward the center of the container. The panels are then fastened together at a point at or near the center of the interior of the container to define a plurality of separate sections within the container. Material is permitted to move between sections at the upper and lower ends of the panels. A third embodiment is a hybrid of the first and second embodiments, and comprises a plurality of flaps, each of which have one edge affixed to the inside surface of one wall of the container. Each flap has a plurality of holes at a plurality of levels. A rope or the like is passed through each of the holes at a level and the rope is then joined at its ends. The support system in Polett therefore involves a significant amount of fabrication effort.

U.S. Pat. No. 5,538,155 (Hoekstra) describes a support system somewhat similar to the hybrid embodiment in Polett in which a baffle "core" is provided, which baffle core is contained within the container and is spaced from the inner surfaces of the walls of the container by side walls which extend from the inner surfaces of the walls toward the center of the container. The baffle core is therefore relatively small in comparison with the size of the container, and fabrication of the container and support structure is made somewhat more complicated by the inclusion of the side walls. Holes are provided in the baffle core to facilitate movement of material into and out of the baffle core.

U.S. Pat. No. 5,660,478 (Alack et al) describes a support system somewhat similar to the first and second embodiments in Polett. In Alack, a plurality of tension members are provided at different levels in the container. These tension members are attached to the walls of the container and either extend between opposite sides of the container or between adjacent sides of the container. As in Polett, the use of the tension members requires four connection points per level for a four sided container.

U.S. Pat. No. 5,328,268 (Lafleur), U.S. Pat. No. 5,421,804 (Lafleur) and U.S. Pat. No. 5,664,887 (Lafleur) all describe a support system for a flexible container which is similar to the first embodiment in Polett, in that closed loops of cord are provided around the inner surfaces of the walls of the container at a plurality of levels. These loops of cord preferably have portions which extend obliquely between adjacent sides of the container. In the preferred embodiment, the cords require a minimum of eight connection points to the walls of the container per level in order to provide the oblique portions, thus adding to fabrication costs.

All of the support systems for flexible containers as detailed above may add significant cost to the fabrication of the container due to the number and types of connections that must be used to attach the support system to the container.

In addition, the support systems detailed above which include apertured baffles often permit the passage of material through the baffle but only while compromising its structural support properties.

For example, in U.S. Pat. No. 5,076,710 (Derby), U.S. Pat. No. 5,165,802 (Derby), U.S. Pat. No. 5,468,528 (Schnaars et al), U.S. Pat. No. 5,556,205 (Gallie et al), U.S. Pat. No. 5,564,833 (Profitt) and U.S. Pat. No. 5,685,644 (Taylor) the baffles include a plurality of relatively large apertures spaced vertically along the centerline of the baffle. These large centralized apertures facilitate easy movement of the material through the baffle but tend to result in bulging of the container adjacent to locations where the apertures are positioned because the strength of the baffle is compromised at those locations.

In U.S. Pat. No. 5,222,812 (Cuddy et al), U.S. Pat. No. 5,328,267 (Cuddy et al), U.S. Pat. No. 5,538,155 (Hoekstra), the apertures tend to be smaller and more evenly distributed on the baffle, resulting in some improvement in the strength and thus the support properties of the baffle. This improvement in strength is offset, however, by the baffle providing a more restrictive passage for material due to the relatively small apertures.

U.S. Pat. No. 5,618,255 (Nickell et al) and U.S. Pat. No. 5,649,767 (Nickell et al) both describe the use of a plurality of "baffle strips" which are attached to a liner for the container with spaces between them to permit the passage of material around the strips. Each baffle strip can thus function as a separate support member, with the ability of material to pass around the baffle strips being governed by the spacing between the strips. Although the system described in Nickell addresses the issue of maintaining the support properties of the baffle, and although the width of the spacing between the strips could conceivably be adjusted to facilitate easy passage of material around the baffle strips, the Nickell system is relatively complicated and could as a result be quite costly to manufacture.

As a result, there remains in the art of flexible containers a need for a flexible container that is relatively easy to manufacture and yet incorporates a relatively efficient support system for assisting in maintaining the shape of the container when it is filled with a material.

SUMMARY OF THE INVENTION

The present invention relates to a flexible container of the type comprising a bottom, a plurality of flexible side walls and a plurality of flexible baffles. In particular, the invention relates to a flexible container of this type where each side wall is comprised of one baffle connection line and wherein each baffle is attached to two adjacent side walls along the baffle connections for those side walls.

In one aspect of the invention, the invention is a flexible container, the container comprising:

(a) a bottom;

(b) a plurality of flexible side walls projecting from the bottom, the side walls and the bottom together defining a container space for containing a material;

(c) one baffle connection line extending along each of the plurality of side walls; and (d) a plurality of flexible baffles contained within the container space, wherein each baffle is attached to two adjacent side walls along the baffle connection lines for those side walls.

In another aspect of the invention, the invention relates to a method for constructing a flexible container of the type comprising a bottom, a plurality of flexible side walls projecting from the bottom, the side walls and the bottom together defining a container space for containing a material, and a plurality of flexible baffles contained within the container space, and is the improvement comprising attaching each baffle to two adjacent side walls along a single baffle connection line on each of the adjacent side walls.

The baffles are preferably attached to the side walls along seams on the side walls so that the seams comprise the baffle connection lines along those side walls to which baffles are attached. The seams on the side walls may be interior seams which are created from inside of the container space. Preferably, however, the seams on the side walls are exterior seams which are created from outside of the container space.

The baffles may be attached to the baffle connection line in any manner, including by gluing, melting, welding, riveting or stapling. Preferably, however, the baffles are attached to the baffle connection line by stitching them to create a seam so that the side walls and the baffles are attached by stitches which define the baffle connection line. The stitching is preferably performed from outside of the container space so that an exterior seam is formed.

The baffles may be attached to the side walls continuously or intermittently along the baffle connection line. The baffle connection line may extend the full height of the side walls or may extend for only a portion of the height of the side walls. Preferably, the baffle connection line extends along substantially the entire height of the side walls so that the baffles are attached to the side walls along substantially the entire height of the container.

The baffle connection lines on the side walls preferably extend in a direction substantially perpendicular to a plane defined by the bottom of the container and may be positioned at any location between the edges where side walls meet adjacent side walls. Preferably, however, the baffle connection lines are positioned approximately midway between the edges of the side walls so that the baffle connection lines substantially bisect the side walls.

The baffles together when attached to the side walls preferably define an interior baffle space within the container space and define an exterior baffle space within the container space. Preferably, the baffles are attached to the side walls such that the interior baffle space adjacent to the baffle connection line on each side wall extends substantially to the inner surface of the side wall.

The baffles may either include or not include apertures to facilitate the passage of material between the interior baffle space and the exterior baffle space. If no apertures are provided in the baffles, the baffles preferably are attached to the side walls such that material may pass underneath the baffles or over the top of the baffles.

Preferably, however, each of the baffles defines at least one aperture for permitting the material to pass between the interior baffle space and the exterior baffle space. More preferably, each of the baffles defines a plurality of baffle strips separated by apertures and preferably each of the baffle strips and apertures extends substantially between the baffle connection lines. Most preferably, the size of each baffle strip and each aperture is substantially the same.

The container may be comprised of any number of side walls and baffles which are capable of defining the container space. It is not necessary that the number of baffles equal the number of side walls. Preferably, however, the container is comprised of four side walls and four baffles. Each side wall and each baffle may be constructed of one panel or piece of material or may be constructed of more than one panel or piece of material. Furthermore, more than one side wall or baffle may be constructed from a single panel or piece of material.

BRIEF DESCRIPTION OF DRAWINGS

Embodiments of the invention will now be described with reference to the accompanying drawings, in which.

DETAILED DESCRIPTION

The present invention relates to a flexible container having a support system comprising a baffle system. The present invention also relates to a method of constructing such a flexible container in a relatively efficient and economical manner.

Figure 1:
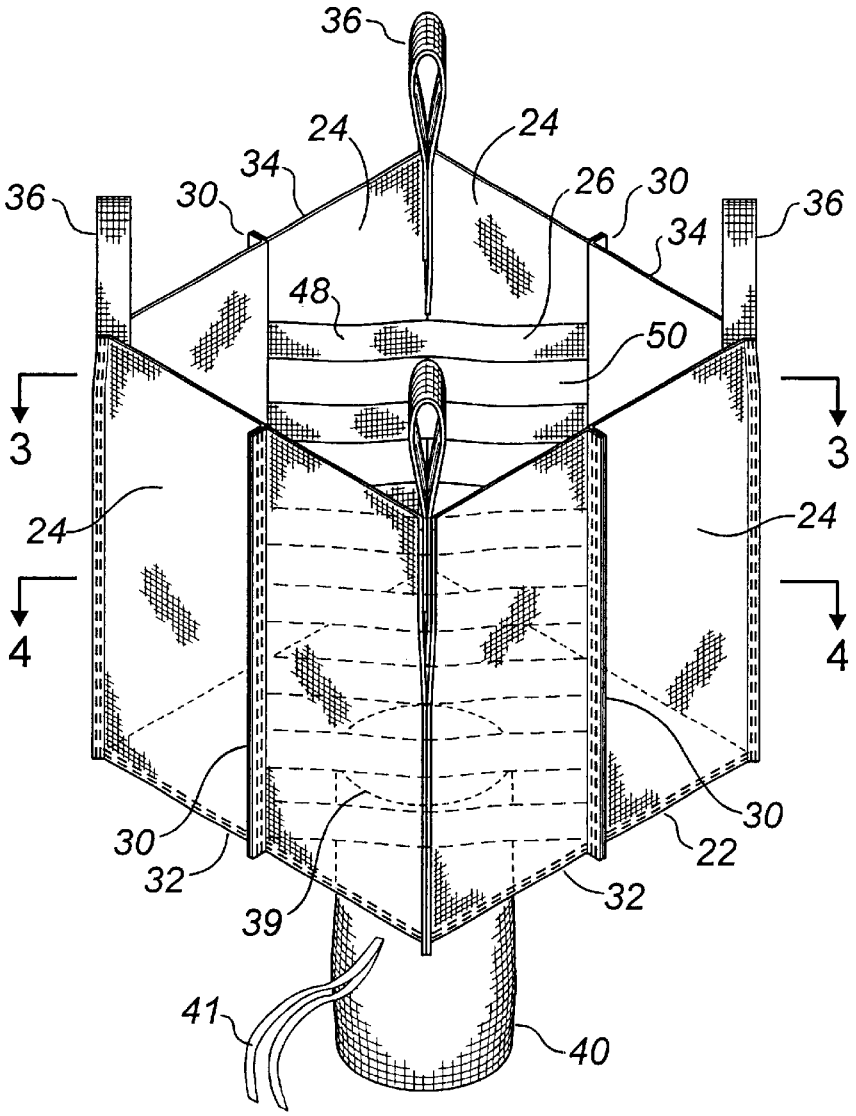
FIG. 1 is a pictorial view of a flexible container according to a preferred embodiment of the invention.

Referring to FIG. 1, the invention is comprised of a flexible container (20). The container (20) comprises a bottom (22), a plurality of side walls (24) and a plurality of baffles (26). The container (20) may also include an upper closure device (not shown). This upper closure device (not shown) may be comprised of any suitable structure, device or mechanism permitting the opening and closing of the container (20).

The container (20), including the side walls (24), the baffles (26), the bottom (22) and the upper closure device (not shown) may be comprised of any material or materials. Preferably the container (20) is comprised of a flexible or semi-rigid material such that the container (20) takes the form of a large bag or sack. For example, the container (20) may be comprised of woven natural or synthetic materials.

The container (20) is preferably comprised of one or more polyolefins such as polypropylene or polyethylene. In the preferred embodiment, the container (20) is comprised of woven polypropylene, which is preferably resistant to ultraviolet light. Depending upon the particular use, it may also be necessary for the container (20) to be chemically resistant, hygienic, resistant to decomposition, have good breathing properties or have other particular qualities or characteristics. The required weight and strength of the woven material will be dependent upon the size and required capacity of the container (20). In addition, for certain applications an inner sack or lining (not shown) may be placed in the container (20). This lining is typically comprised of a moisture proof material such as a polyethylene film.

The side walls (24) project from the bottom (22) so that the side walls (24) and the bottom (22) together define a container space (28) for containing a material (not shown). The flexible container (20) may be comprised of any number of side walls (24) which are capable of defining the container space (28). As a result, the container (20) may have as few as two side walls (24). There is no upper limit to the number of side walls (24). In the preferred embodiment, the container (20) has four side walls (24) so that the container is rectangular in transverse cross section, thus increasing the efficiency with which multiple containers (20) can be packed and stacked.

Each side wall (24) has one baffle connection line (30) which extends along the side wall (24). In the preferred embodiment the baffle connection lines (30) extend in a direction substantially perpendicular to a plane defined by the bottom (22) of the container (20). Each baffle (26) is contained within the container space (28) and is attached to two adjacent side walls (24) at the baffle connection lines (30) for those side walls (24).

It is preferred but it is not necessary that the number of baffles (26) match the number of side walls (24). For example, there may be as few as two baffles (26) spanning as few as three side walls (24), even if the container (20) is comprised of more than three side walls (24). If, however, the number of baffles (26) is less than the number of side walls (24), the ability of the baffles (26) to provide structural support to the container will be compromised. There may also be a larger number of baffles (26) than there are side walls (24). If there is a larger number of baffles (26) than side walls (24), the "extra" baffles may attach to the container (20) at the baffle connection lines (30) or elsewhere.

In the preferred embodiment, however, the number of baffles (26) is equal to the number of side walls (24) so that there are four baffles (26). As a result, in the preferred embodiment the baffle connection line (30) for each side wall (24) serves as a junction for two baffles (26), reducing by half the number of connection locations in comparison with prior art corner baffle systems which call for two baffle connection lines (30) per side wall (24).

The baffles (26) are preferably attached to the side walls (24) along seams on the side walls (24) of the container (20) so that the seams comprise the baffle connection lines (30) for those side walls (24) to which baffles (26) are attached. The seams on the side walls (24) may be interior seams which are created from inside of the container space (28). In the preferred embodiment, the seams on the side walls (24) are exterior seams which are created from outside of the container space (28). In this specification, reference to a "seam" includes a seam which consists of more than one row of attachment locations.

The baffles (26) may be attached to the baffle connection line (30) in any manner, including by gluing, melting, welding, riveting or stapling. In the preferred embodiment, the baffles (26) are attached to the baffle connection line (30) by stitching them to create a seam so that the side walls (24) and the baffles (26) are attached by stitches which define the baffle connection line (30). The stitching is preferably performed from outside of the container space (28) so that an exterior seam is formed. In the preferred embodiment, the exterior seams are comprised of one or two rows of stitching. Most preferably, the exterior seams are comprised of only one row of stitching in order to save on labour and material costs, but any number of rows of stitching may be used in constructing the container (20).

There are several methods by which an exterior seam may be created. For example, the material making up the side walls (24) may simply be gathered around the baffles (26) at the baffle connection line (30) and the baffles (26) can then be attached to the side wall (24) by gluing, melting, welding, riveting, stapling, stitching or some other method which can be applied through the gathered material to create the seam. The advantage to this method is that the side walls (24) may be comprised of as few as one panel of flexible material.

Figure 2:
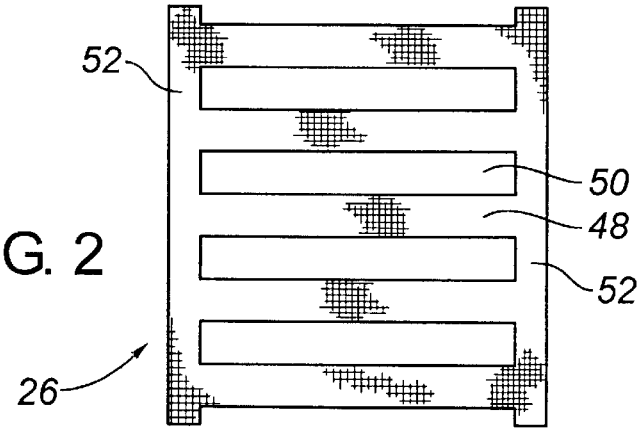
FIG. 2 is a side view of a baffle from the flexible container of FIG. 1.
Figure 3:
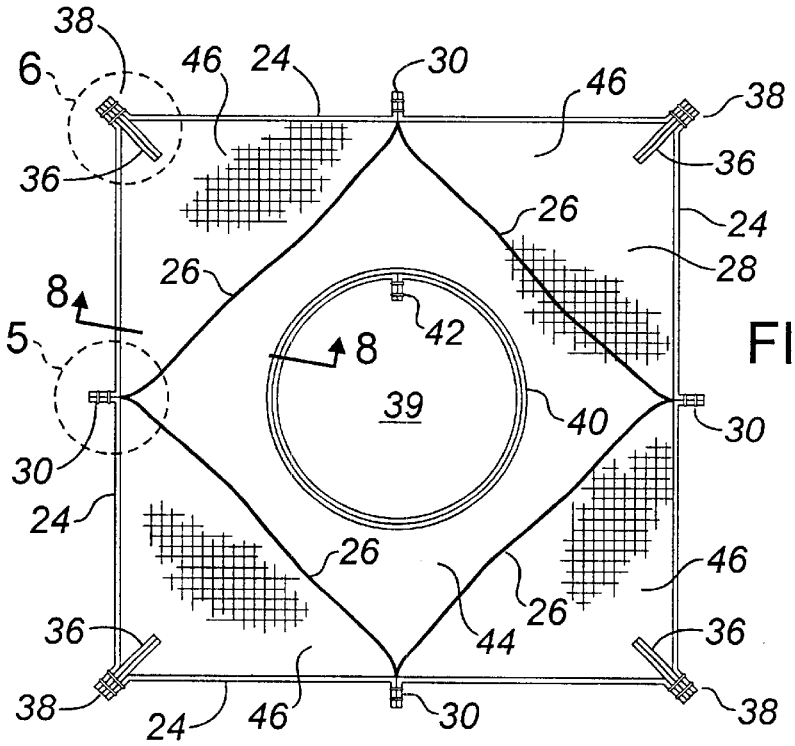
FIG. 3 is a transverse section view of the flexible container of FIG. 1 taken along line 3—3.
Figure 4:
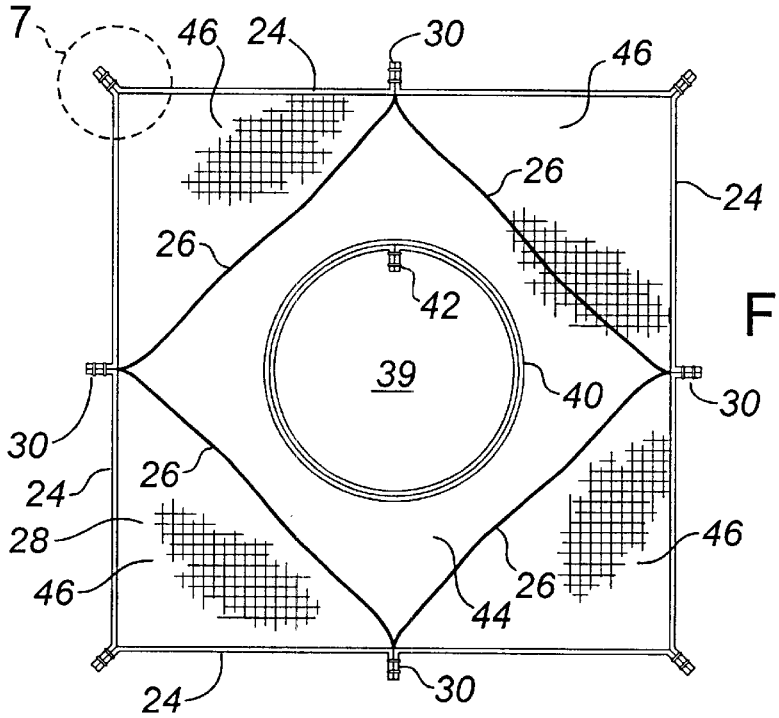
FIG. 4 is a transverse section view of the flexible container of FIG. 1 taken along line 4—4.

Alternatively, and referring to FIGS. 1–3, the side walls (24) may be constructed of more than one panel or piece of material which are connected by gluing, melting, welding, riveting, stapling, stitching, or some other method at the baffle connection lines (30) along the same seam that attaches the baffles (26) to the side walls (24).

Interior seams may be created by either of the two above methods or merely by attaching the baffles (26) to the side walls (24) along the interior surfaces of the side walls (24) by gluing, melting, welding, riveting, stapling, stitching or some other method without first gathering or separating the side walls (24).

Regardless of whether exterior seams or interior seams are used in the invention, the side walls (24) of the container may therefore all be comprised of the same panel of material, or the side walls may be comprised of any number of panels connected together. The preferred number of panels making up the side walls (24) will depend upon considerations relating to fabrication costs. The side walls (24) and any panels making up the side walls (24) may be connected together in any manner, including by gluing, melting, welding, riveting, stapling, stitching or some other method.

Referring to FIGS. 1–3 and 8, in the preferred embodiment the side walls (24) are made up of eight panels, with each side wall (24) being comprised of two panels which are stitched together along the seams at the baffle connection lines (30) and are stitched to adjacent side walls (24) at the corners defining the junction between two side walls (24). In an alternate preferred embodiment, the side walls (24) are made up of four panels which are connected together along the seams at the baffle connection lines (30) so that each panel forms part of two adjacent side walls (24).

Figure 8:
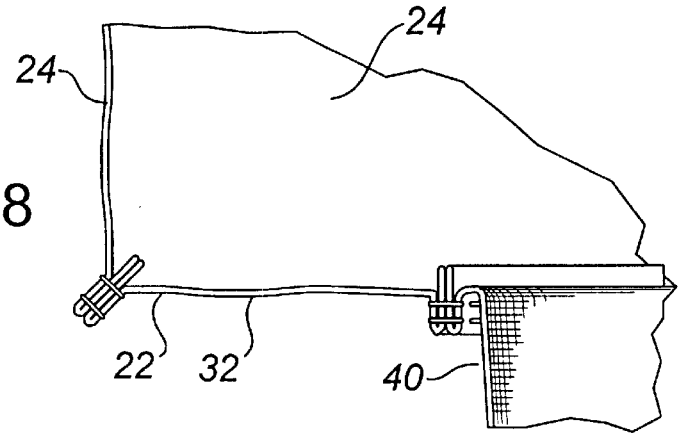
FIG. 8 is a detail section view of the junction of the bottom and the discharge chute of the flexible container of FIG. 1, taken along line 8—8 of FIG. 3.
Figure 9:
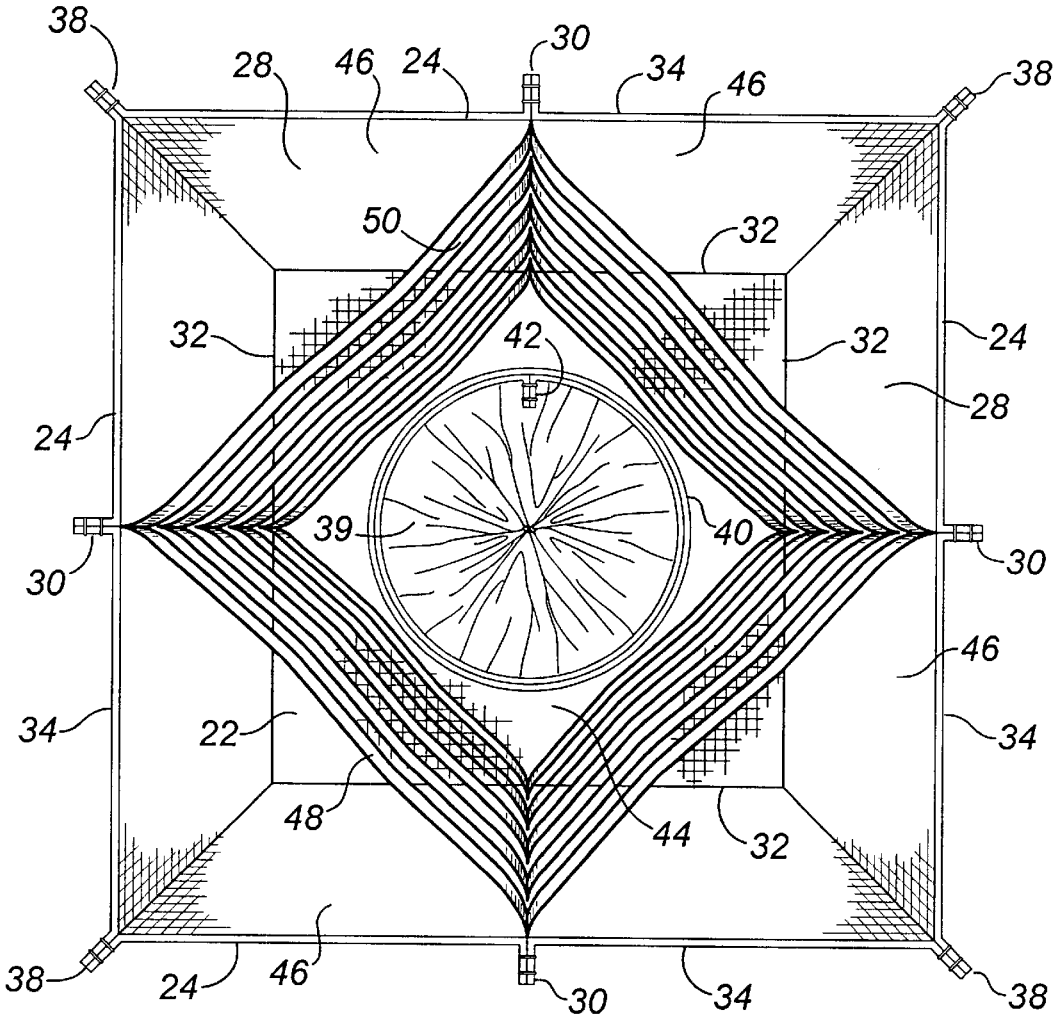
FIG. 9 is a top plan view of the flexible container of FIG. 1.

The baffle connection lines (30) on the side walls (24) may be located anywhere between the corners defining the junction between two side walls (24). Preferably, the baffle connection lines (30) are located so that the baffles (26) are attached symmetrically within the container space (28). Referring to FIG. 8, in the preferred embodiment the baffle connection lines (30) are located at or near the middle of the side walls (24) so that they substantially bisect the side walls (24).

Referring to FIG. 1, the side walls (24) of the container (20) each have a height which defines the height of the container (20). Each side wall (24) has a lower edge (32) which is joined to the bottom (22) of the container (20) and an upper edge (34). The height of each side wall (24) is defined by the distance between the lower edge (32) and the upper edge (34).

The seams along which the baffles (26) are attached to the side walls (24) may extend along any portion of the height of the side walls (24). For example, if the baffles (26) do not include apertures to permit material to pass through the baffles (26), the seams will preferably not extend along the entire height of the side walls (24) so that material can either pass underneath or overtop of the baffles (26). Referring to FIG. 1, in the preferred embodiment where the baffles (26) include apertures, the seams extend substantially along the entire height of the side walls (24).

The side walls (24) may be connected to the bottom (22) of the container (20) in any manner, including by gluing, melting, welding, riveting, stapling, stitching or some other method. In the preferred embodiment, the side walls (24) are connected to the bottom (22) of the container (20) by one or two rows of stitching between the lower edges (32) of the side walls (24) and the edges of the bottom (22).

Referring to FIG. 1, the container (20) may also be comprised of at least one lifting device. Any type of lifting device may be used with the invention, but preferably the lifting device is comprised of one or more lift straps (36). Any number of lift straps (36) and any type of lift strap (36) may be used, and the lift straps (36) may be attached to the container (20) in any manner. The lift straps (36) may also be constructed from any material which will adequately support the weight of the container (20) when it is full.

Figure 5:
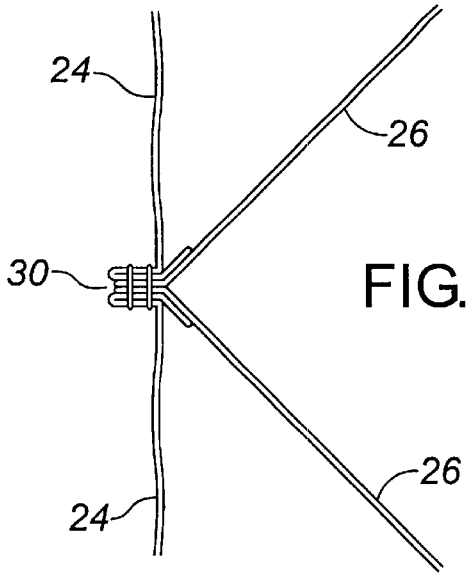
FIG. 5 is a detail section view of a baffle connection line of the flexible container of FIG. 1, taken along line 3—3 of FIG. 1.
Figure 6:
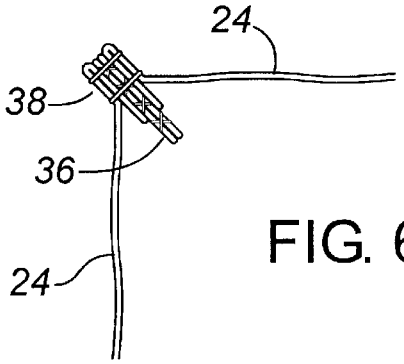
FIG. 6 is a detail section view of a junction of two adjacent side walls of the flexible container of FIG. 1, taken along line 3—3 of FIG. 1.

In the preferred embodiment, and referring to FIG. 1 and FIG. 5, the container (20) is equipped with four lift straps (36) which are constructed from the same material as the side walls (24), each of which lift straps (36) is stitched into an upper corner (38) of the container (20) with one or two rows of stitching. The lift straps (36) are used for handling the container (20) when the container (20) has been filled with material.

Referring to FIG. 1, the container (20) may also be comprised of a discharge device for discharging material from the container (20). Any type of discharge device may be used with the invention, but preferably the discharge device is located on the bottom (22) of the container (20) so that the container (20) can be emptied without being tipped.

In the preferred embodiment, the discharge device is comprised of a discharge chute (40) which projects downward from an orifice (39) located on the bottom (22) of the container (20). This discharge chute (40) is equipped with a closure tie (41) which is tied to prevent discharge of material from the discharge chute (40) and is untied to permit discharge of material from the discharge chute (40).

Figure 7:
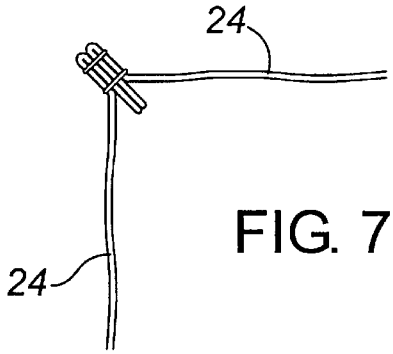
FIG. 7 is a detail section view of a junction of two adjacent side walls of the flexible container of FIG. 1, taken along line 4—4 of FIG. 1.

The discharge chute (40) may be attached to the bottom (22) of the container (20) in any manner. Referring to FIG. 7, in the preferred embodiment the discharge chute (40) is formed from one panel of material which is stitched together along opposite edges to form a cylinder by creating an external chute seam (42) of one or two rows of stitching. The discharge chute (40) is then attached to the bottom by creating an external seam of one or two rows of stitching between the bottom (22) and the discharge chute (40). Although any material may be used for the discharge chute (40), in the preferred embodiment the discharge chute (40) is constructed from the same material as the side walls (24).

Referring to FIG. 8, in the preferred embodiment the container (20) when viewed from above includes the container space (28) which is defined by the side walls (24) and the bottom (22) of the container (20). The container (20) also includes an interior baffle space (44) within the container space (28) and an exterior baffle space (46) within the container space (28), both of which are defined by the plurality of baffles (26).

One of the features of the preferred embodiment of the invention is that the interior baffle space (44) adjacent to the baffle connection line (30) on each side wall (24) extends substantially to the interior surface of the side wall (24). As a result, the cross-sectional area of the interior baffle space (44) is maximized within the limits imposed by the size of the container space (28).

The baffles (26) may or may not include apertures to permit material to pass through them. If the baffles (26) are not equipped with apertures, their height is preferably less than the height of the side walls (24) so that material can either pass underneath the baffles (26) or overtop of the baffles (26) in order to move between the interior baffle space (44) and the exterior baffle space (46).

Preferably each of the baffles (26) includes at least one aperture for permitting material to pass between the interior baffle space (44) and the exterior baffle space (46), in which case the baffles (26) preferably extend along substantially the entire height of the side walls (24). Although the aperture or apertures may be of any shape or size, small apertures tend to restrict the passage of material between the interior baffle space (44) and the exterior baffle space (46), and apertures which do not extend substantially across the entire width of the baffle (26) are believed to cause bulging of the container (20).

As a result, each baffle (26) is preferably comprised of a plurality of baffle strips (48) which are separated by apertures (50) and preferably both the baffle strips (48) and the apertures (50) extend substantially between the baffle connection lines (30) which are spanned by that baffle (26). The function of the baffle strips (48) is to provide uninterrupted structural support to the container (20) between two baffle connection lines (30) and the function of the apertures is to permit passage of material between the interior baffle space (44) and the exterior baffle space (46).

In the preferred embodiment, a balance is sought between support of the container (20) by the baffles (26) and permitting relatively unrestricted passage of material between the interior baffle space (44) and the exterior baffle space (46). This balance is achieved in the preferred embodiment by making each baffle strip (48) substantially the same size as each aperture (50) so that the respective areas of baffle strip (48) and aperture (50) on each baffle (26) are substantially the same.

Each baffle (26) of the plurality of baffles (26) may be comprised either of one piece of material or of a plurality of pieces of material connected together. Furthermore, more than one baffle (26) may be comprised of the same panel or piece of material. As a result, the plurality of baffles (26) may be comprised of one continuous piece of material, one piece of material for each baffle (26), or a plurality of pieces of material for any one baffle (26).

In the preferred embodiment, each baffle (26) is comprised of one piece of material so that there are four pieces of material making up the four baffles (26). Referring to FIG. 8, each baffle (26) is further comprised of a pair of baffle connection strips (52) which extend along both side edges of the baffle (26) for substantially the entire height of the baffle (26). These baffle connection strips (52) facilitate attachment of the baffle (26) to the baffle connection lines (30). The baffle strips (48) and the apertures (50) extend between the baffle connection strips (52).

The invention also relates to a method for constructing the container (20). In the preferred embodiment of the invention, the container (20) is comprised of four side walls (24), four baffles (26), one bottom (22), four lift straps (36) and one discharge chute (40). The four side walls (24) are comprised of eight pieces of material and the four baffles (26) are comprised of four pieces of material.

The pieces of material making up the container (20) may be connected together in any manner, including by gluing, melting, welding, riveting, stapling, stitching or some other method. In the preferred embodiment, each of the pieces of material making up the container (20) are connected with one or two rows of stitching, although any number of rows of stitching may be used. Most preferably, the pieces of material making up the container (20) are connected with only one row of stitching in order to save on labour and material costs.

There are eight lines of connection necessary to create and connect the side walls (24). Four of these lines of connection will be along the four corners which define the junctions of the side walls (24) and will be made by creating external seams of one or two rows of stitching to connect two side walls (24) together and to simultaneously attach one lift strap (36) to each of the corners along the upper edges (34) of the side walls (24). The other four lines of connection will be at the baffle connection lines (30), and will be made by creating external seams of one or two rows of stitching to connect the pieces of material making up the side walls (24) and to simultaneously attach two baffles (26) to the baffle connection lines (30) along the seams.

The discharge chute (40) is constructed by rolling a piece of material into a cylinder and then creating the external chute seam (42). The discharge chute (40) is then attached to the orifice (39) on the bottom (22) of the container (20) by creating an external seam of one or two rows of stitching between the discharge chute (40) and the bottom (22). The bottom (22) of the container (20) is then attached to the four side walls (24) by creating an external seam of one or two rows of stitching between the side walls (24) and the bottom (22).

As can be seen, the container (20) of the present invention is very simple to construct and reduces by half the number of seams that must be created to install a baffle system in a flexible container in comparison with most conventional prior art flexible containers having corner baffle systems. In addition, in the preferred embodiment of the invention the container (20) is constructed entirely by creating external seams, thus eliminating the need to create internal seams, which add cost and time to the fabrication process.

The container (20) of the present invention also provides a relatively effective and efficient system for supporting the container (20) due to the symmetrical placement of the baffles (26) in the container (20). This efficiency and effectiveness is enhanced in the preferred embodiment due to the shape and configuration of the baffle strips (48) and apertures (50) that are provided in the baffles (26).

The embodiments of the invention in which an exclusive property or privilege is claimed are defined as follows:

1. A flexible container, the container comprising:

(a) a bottom;

(b) a plurality of flexible side walls projecting from the bottom, the side walls defining a rectangular side wall perimeter, the side walls and the bottom together defining a rectangular container space for containing a material and wherein each side wall is comprised of an interior surface;

(c) one baffle connection line extending along each of the plurality of side walls, wherein each baffle connection line is comprised of an exterior seam outside of the container space; and (d) a plurality of flexible baffles contained within the container space and together defining an interior baffle space therein, wherein each baffle is attached to two adjacent side walls along the baffle connection line for each of the adjacent side walls without a connecting strip separating the interior baffle space from the side wall perimeter such that the interior baffle space adjacent to the baffle connection line on each side wall extends to the side wall perimeter.

2. The flexible container as claimed in claim 1 wherein there is an equal number of side walls and baffles.

3. The flexible container as claimed in claim 2 wherein two baffles are attached to each of the side walls by stitches located along the seam on that side wall.

4. The flexible container as claimed in claim 2 wherein each side wall has a height and wherein each seam extends along substantially the entire height of the side wall.

5. The flexible container as claimed in claim 4 wherein the seam on each side wall extends in a direction substantially perpendicular to a plane defined by the bottom of the container and wherein the seam on each side wall substantially bisects the side wall.

6. The flexible container as claimed in claim 5 wherein the container is comprised of four side walls and wherein the container is comprised of four baffles.

7. The flexible container as claimed in claim 6, wherein the plurality of baffles together further define an exterior baffle space within the container space and wherein each of the baffles defines at least one aperture for permitting the material to pass between the interior baffle space and the exterior baffle space.

8. The flexible container as claimed in claim 7 wherein each of the baffles defines a plurality of baffle strips separated by apertures for permitting the material to pass between the interior baffle space and the exterior baffle space and wherein each of the baffle strips and apertures extends substantially between the baffle connection lines.

9. The flexible container as claimed in claim 8 wherein each baffle strip has a size, wherein each aperture has a size and wherein the sizes of the baffle strips and the apertures are substantially the same.

10. In a method for constructing a flexible container of the type comprising a bottom, a plurality of flexible side walls projecting from the bottom, the side walls defining a rectangular side wall perimeter, the side walls and the bottom together defining a rectangular container space for containing a material and wherein each side wall is comprised of an interior surface, and a plurality of flexible baffles contained within the container space and together defining an interior baffle space therein, the improvement comprising the step of attaching each baffle to two adjacent side walls along a single baffle connection line on each of the adjacent side walls without a connecting strip separating the interior baffle space from the side wall perimeter such that the interior baffle space adjacent to the baffle connection line on each side wall extends to the side wall perimeter, wherein each baffle connection line is comprised of an exterior seam outside of the container space.

11. The method as claimed in claim 10 wherein there is an equal number of side walls and baffles.

12. The method as claimed in claim 11 further comprising the step of attaching two baffles to each of the side walls by stitching them to the side wall from a location outside of the container space in order to form the seam.

13. The method as claimed in claim 11 wherein each side wall has a height and wherein the seam extends along substantially the entire height of the side wall.

14. The method as claimed in claim 13 wherein the seam on each side wall extends in a direction substantially perpendicular to a plane defined by the bottom of the container and wherein the seam on each side wall substantially bisects the side wall.

15. The method as claimed in claim 14 wherein the container is comprised of four side walls and wherein the container is comprised of four baffles.

* * * * *